United States Patent [19]

Miculka et al.

[11] 4,238,939

[45] Dec. 16, 1980

[54] APPARATUS FOR THE CONTINUOUS THERMAL TREATMENT OF FLEXIBLE SHEET MATERIAL

[75] Inventors: Zdeněk Mičulka, Otrokovice; Vladislav Janirek, Gottwaldov; Vladimir Rektořik, Otrokovice; Karel Baják, Krnov, all of Czechoslovakia

[73] Assignee: Vyzkumny ustav kozedelny, Gottwaldov, Czechoslovakia

[21] Appl. No.: 25,271

[22] Filed: Mar. 29, 1979

[30] Foreign Application Priority Data

Mar. 31, 1978 [CS] Czechoslovakia ..... 2065/78

[51] Int. Cl.[3] ..... C14B 1/06; C14B 17/00

[52] U.S. Cl. ..... 69/43; 69/48

[58] Field of Search ..... 69/33, 43, 48; 38/44, 38/55, 57; 100/93 RP, 168

[56] References Cited

U.S. PATENT DOCUMENTS

| | | | |
|---|---|---|---|
| 1,455 | 12/1839 | Palmer | 69/43 |
| 2,317,493 | 4/1943 | Stout et al. | 69/43 |
| 2,381,671 | 8/1943 | Ladner | 69/43 |
| 2,418,913 | 4/1947 | Stout et al. | 69/43 |
| 3,367,262 | 2/1968 | Stevens et al. | 100/168 X |
| 3,587,258 | 6/1971 | Otrokovice | 69/43 |
| 4,142,386 | 3/1979 | Dokoupil | 69/43 |

FOREIGN PATENT DOCUMENTS

| | | | |
|---|---|---|---|
| 2620667 | 1/1977 | Fed. Rep. of Germany | 69/48 |
| 1441113 | 6/1976 | United Kingdom | 69/43 |

*Primary Examiner*—James Kee Chi

[57] ABSTRACT

Apparatus for the continuous thermal treatment of flexible sheet material includes a heated cylinder which is rotatably mounted in a frame. The presser cylinder is arranged in parallel spaced relation to the heated cylinder so as to permit passage of sheet material therebetween. The lever member is pivotably carried by the frame and a beam member which extends generally parallel to the presser cylinder is pivotably mounted on the lever member. A drive cylinder is rotatably carried by the frame on the side of the presser cylinder which is remote from the heated cylinder, the drive cylinder extending parallel to the presser cylinder. The presser cylinder is freely supported on the drive cylinder and is rotatable thereby. Elements are carried by the lever member and by the beam member which are cooperable for regulation of the spacing between the presser and heated cylinders. A fluid motor mechanism is desirably carried by the frame and is connected to the lever member for pivoting the lever member relative to the frame in selected directions.

9 Claims, 3 Drawing Figures

APPARATUS FOR THE CONTINUOUS THERMAL TREATMENT OF FLEXIBLE SHEET MATERIAL

This invention relates to apparatus for the continuous thermal treatment of flexible sheet material and more particularly to such apparatus for thermal processing skins and leathers.

It has been conventional practice, in the production of natural and simulated leathers to carry out certain procedures under the influence of heat or under the combined influence of heat and pressure. Typical of such procedures is the ironing, polishing and thermal-difusional moistening of the materials. It has also been known heretofore to subject skins and leathers to flame treatment in order to impart ornamental surface effects thereto. In such treatment the surface layer is thermally denatured. Such flame treatment has been found especially suitable in the production of localized decorative effects rather than in the treatment of the entire surface of the skins or leathers.

Until the advent of the present invention the continuous thermal treatment of an entire surface of a skin or leather has been performed in apparatus which includes a heated cylinder and a presser cylinder. Endless resilient conveyor belts are passed between such cylinders with the material to be treated interposed between the belts. However, the heat from the heated cylinder had to penetrate one of the belts in order to reach the material being processed and this occasioned certain disadvantages. The apparatus was thus of value only with heat treatment procedures which were performed at relatively low temperatures and over relatively long periods of time of at least several seconds. Appropriate procedures carried out with such apparatus were the ironing, polishing and thermal difusional mostening techniques previously mentioned. The period of time for effecting thermal treatment of the material could, of course, be regulated by the length of the conveyor belts which were in contact with the heated cylinder and/or by the speed of the belts; however, such prior apparatus was not suitable for treatment of skins and leathers under conditions of short term duration and high temperatures, e.g. temperatures of the order of 200° C. or higher. Such conveyor belts were limited to relatively low speeds in order to avoid excessive slippage and to low temperatures in order to avoid degradation of the belt material. Belts made of steel or other material capable of withstanding high temperatures were generally unsatisfactory because of the considerable heat losses which occurred.

Apparatus for treating skins and leathers at high temperatures for short periods of time have been available prior to the present invention. In such apparatus the presser cylinder directly forces the material being treated into contact with the heated cylinder. The resilient layer of rubber or a similar material is generally provided on the presser cylinder in order to compensate for variations in the thickness of the material being processed; however, such layer is not capable of resisting the high temperature conditions and is degraded in a relatively short time. Replacement of this resilient layer or of the presser cylinder which might be damaged as a result of exposure to the high temperature led to interruptions in production and consequently in increased production costs.

In view of the foregoing, it is one object of the present invention to provide apparatus for the continuous thermal treatment of flexible sheet material such as skins and leathers which apparatus is capable of functioning under conditions of relatively high temperature without the need for frequent replacement of elements which might be degraded through exposure to high temperature.

It is another object of the invention to provide apparatus for the continuous thermal treatment of flexible sheet material such as skins and leathers which compensates for variations in the thickness of the material being processed.

It is still another object of the invention to provide apparatus for the continuous thermal treatment of flexible sheet material such as skins and leathers which include a heated cylinder and a presser cylinder maintained at predetermined space distance apart so that material to be processed can pass therebetween, the apparatus including a mechanism for simply adjusting such spacing between the heated and presser cylinders.

Other objects and advantages of the invention will become readily apparent to persons skilled in the art from the ensuing description.

SUMMARY OF THE INVENTION

In accordance with the present invention there is provided a frame; a heated cylinder rotatably mounted on the frame; a lever member pivotably carried by the frame; a beam member extending generally parallel to a presser cylinder and mounted pivotably on the lever member; a drive cylinder rotatably carried by the frame on the side of the presser cylinder remote from the heated cylinder and extending parallel to the presser cylinder; a presser cylinder freely supported by the drive cylinder and rotatable thereby; means for selectively pivoting the beam member relative to the lever member so as to regulate the spacing between the presser and heated cylinders; and means for selectively pivoting the lever member relative to the frame.

BRIEF DESCRIPTION OF THE DRAWINGS

In order that the invention may be more fully comprehended it will now be described, by way of example, with reference to the accompanying drawings in which.

DESCRIPTION OF THE PREFERRED EMBODIMENTS

Figure 1:
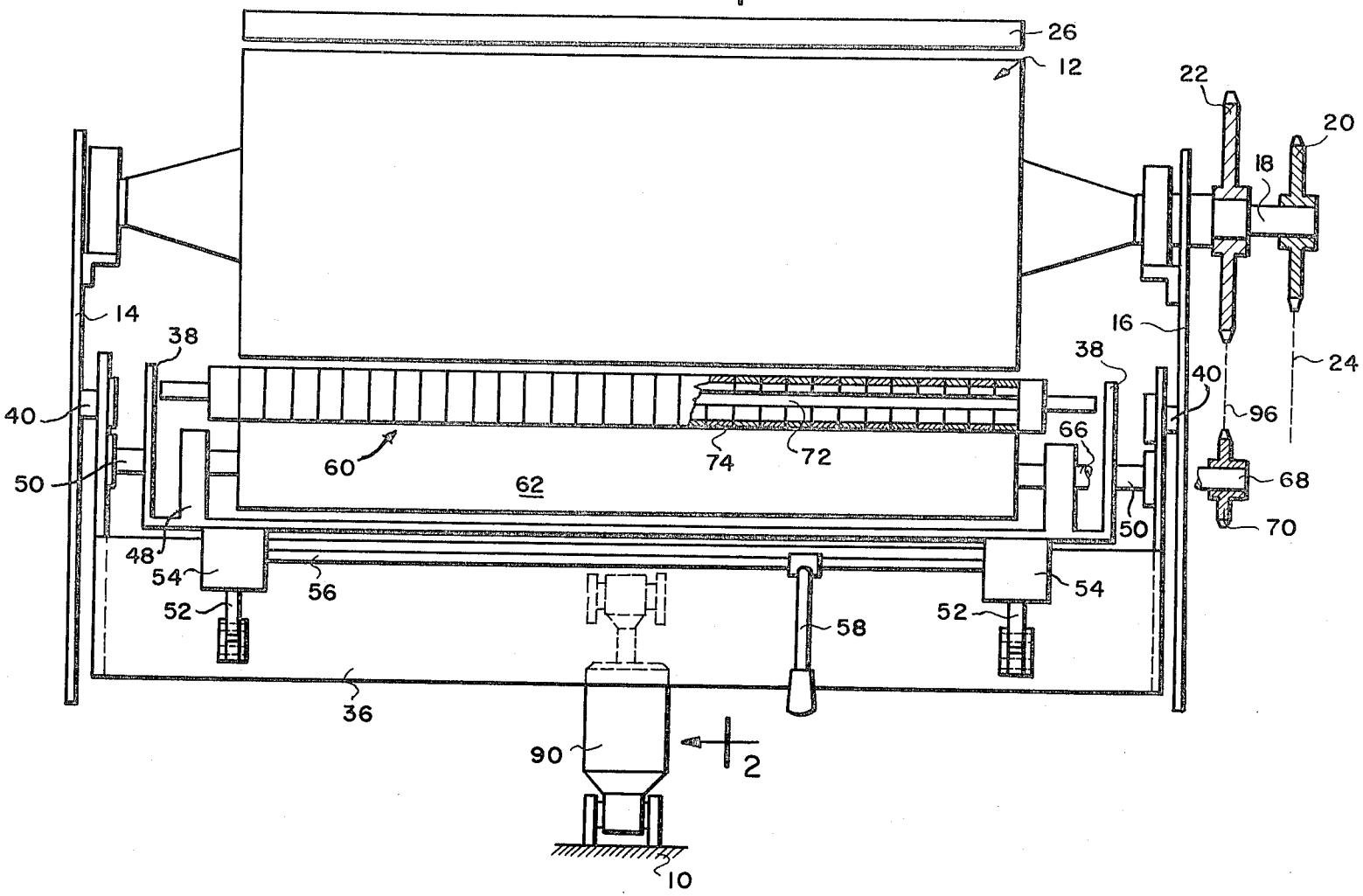
FIG. 1 is a diagrammatic front view of apparatus for the thermal treatment of skins and leathers embodying the features of the invention.

Referring to the drawings, the apparatus of the invention includes a frame 10. A heated cylinder 12 is journalled within opposed side walls 14, 16 of the frame. At one end of the heated cylinder, there is provided a hollow journal extension 18 which supports a pair of drive wheels 20, 22. Such drive wheels, as will be understood may comprise sprocket, pulleys, or the like. Drive wheel 20 is connected by means of a belt or chain 24 to an electric motor (not shown) by means of which such drive wheel, journal 18, and the heated cylinder 12 may be rotated. A heating casing 26 is pivotably journalled at 28 and extends circumferentially about a portion of the heated cylinder. Heating casing 26 connected with a source of thermal energy in a known monomer is in close proximity to the cylinder so as to enable the heating thereof as desired. A heat sensor 30 is operably connected to the heated cylinder and is adapted to afford the desired temperature regulation of the heated cylinder. A knife holder 32 is carried by the frame and supports a knife 34 therein. The knife is arranged to act upon the surface of the heated cylinder so as to maintain the surface thereof free of any incrustation or other bodies which may accumulate during operation and to ensure that the peripheral surface of the heated surface which contacts the material being processed is free of impurities and to present to the sheet material a surface of substantially uniform temperature throughout. The scraping knife 34, and/or its holder 32, may be operably connected with means for suitable vibration or reciprocation of the knife relative to the heated cylinder. Such means for effecting the vibrational or reciprocating movement of the knife are well known and need not be described herein.

Figure 2:
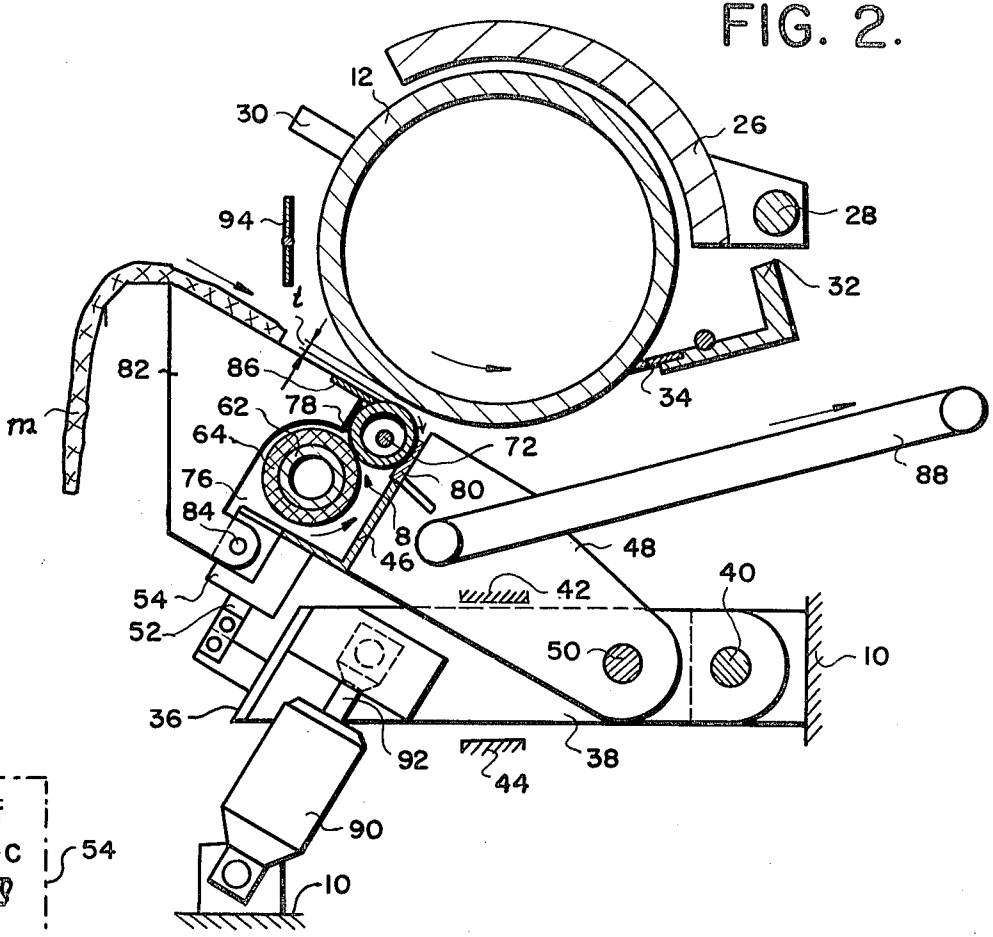
FIG. 2 is a cross-sectional view of the apparatus shown in FIG. 1 taken along line 2—2 thereof.

As can be seen most clearly from FIG. 2, a lever member 36 is carried by arms 38 by one or more journals 40 secured to the walls of the frame 10. The journals 40 are provided to enable the pivotable movement of the lever relative to the frame. A pair of stop members 42, 44 are provided for respectively limiting the upper and lower movement of the lever member. An L-shaped beam member 46 is carried by a pair of arms 48 pivotably secured by pivot pins 50 journalled in the arms 38 of the lever member 36. Thus, the lever member 36 is pivotable relative to the frame and the beam member 46 is pivotable relative to the lever member while extending generally parallel to the heated cylinder.

Figure 3:
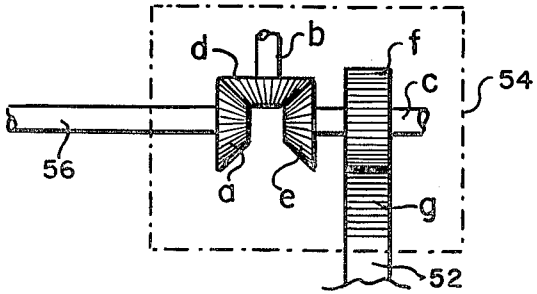
FIG. 3 is an enlarged view of the details of the gearing means employed therein.

Movement of the beam member 46 relative to the lever member 36 is effected by cooperable members 52 and 54 which are provided at longitudinally spaced locations along the beam and lever members and are interconnected as seen in FIG. 1 by means of a cross-bar 56 and a handle 58 such that the longitudinally spaced cooperable elements may be synchronously moved. Such cooperable elements may, for example, be seen in FIG. 3, and comprise a first bevel gear a mounted at the end of the cross-bar 56, a stub shaft c, having a second bevel gear e, and a spur pinion b intermeshing the two. The stub shaft, the cross-bar and pinion shaft are suitably journalled in the housing of the cooperable member 54. The member 52 is provided with a ratchet g at its end which engages a gear f on the stub shaft, so that movement of member 52 is transmitted to the cross-bar 56. The cooperative elements may take other forms such as a ratchet arrangement, a rack-and-pinion arrangement, or other equivalent mechanisms. In any event the cooperative elements enable an incremental adjustment of the beam member relative to the lever member so as to thereby establish a clearance "t" between the heated cylinder 12 and a presser cylinder 60 carried by the beam 46. It will be, of course, understood that the cooperable elements 52 and 54 should be capable of being locked at the position selected so as to maintain clearance "t" during operation of the machine.

Mounted within the beam member 46 is a drive cylinder 62 having a resilient surface layer 64. The drive cylinder is journalled by means of shaft 66 in the beam member which is operably connected with a shaft 68 on a wheel 70, via a clutch member (not shown). The wheel 70 is connected to the wheel 22 so that the drive cylinder can be driven by the central motor.

The presser cylinder 60 rests on and is freely supported upon drive cylinder 62 such that upon rotation of the drive cylinder, the presser cylinder is also rotated. The presser cylinder comprises a central bar or shaft 72 and a plurality of ring member 74 mounted thereon. The ring members 74 are individually slidable axially on the bar and generally radially with respect thereto in order to accommodate variations in the thickness of the material being processed by the machine. Caps 76 are provided for retaining the rings on shaft 72 in substantially fixed axial position thereon. Guide elements 78 and 80 are provided to hold the presser cylinder in fore and aft position. The fore guide element 78 is carried on a tiltable table 82 while the aft guide element 80 is carried by beam member 46. In a preferred form such guide elements take the form of slotted members with each of the slots being arranged to slidably receive one of the ringed members 74.

The tiltable table 82 is mounted on beam member 46 by means of one or more pivot pins 84 so that the table can pivot thereabout. A transit plate 86 is carried by the table 82 and assists in the guiding of material "m" through the space "t" between the presser cylinder and the heated cylinder. A conveyor 88 is arranged rearwardly of the presser and heated cylinders to receive the sheet material which has been thermally treated.

There is pivotably supported on frame 10 fluid motor means such as a pneumatic or an hydraulic cylinder 90 having a connecting rod 92. The connecting rod at its end remote from the hydraulic cylinder 90 is connected to the lever member 36, and, therefore, provides for selected pivotable movement relative to frame 10. A safety or security bar 94 is movably supported in the frame and such bar is operably connected to a circuit breaker in the electrical circuit containing the motor for drive wheel 20, as well as to the control system for fluid motor 90. It will be understood that in emergency situations, the safety bar 94 can be actuated to stop the drive motor thus arresting drive wheels 20, 22 and drive wheel 70, etc. It will also function so that control system for the fluid motor 90 will be actuated so as to retract the rod 92 pivoting lever member 36 downwardly against stop 42.

In such emergency instances, the clearane "t" between the heated cylinder 12 and presser cylinder 60 will be increased since beam 46 will be shifted downwardly together with the lever member. Separate control means can desirably be provided for deactivating the electric motor and for controlling fluid motor 90. Reactivation of the machine requires the positive effectuation of movement of connecting rod 92 so as to pivot the lever member 36 against the upper stop member 40 thereby repositioning the presser cylinder 60 in its correct spacing "t" relative to the heated cylinder for further operation of the machine.

In operating the apparatus, the clearance "t" between the heated cylinder 12 and presser cylinder 60 should first be set to a precise limit by adjusting the cooperable means 52, 54 through operation of the cross-bar 56 and handle 58 thereby shifting beam 46 upwardly or downwardly relative to the lever member.

Once the clearance "t" between heated cylinder 12 and presser cylinder 60 has been set as described above, the material "m" to be processed is placed upon the tilt table 82 and arranged on transit plate 86 for passage between the heated cylinder 12 and presser cylinder 60. The machine is activated, and drive wheels 20, 22 are rotated by the electric motor. With the clutch engaged, drive wheel 70 thereof is driven by wheel 22 and belt 96, thereby rotating drive cylinder 62. The presser cylinder, resting freely upon the drive cylinder for rotation therewith, is rotated and the material "m" is automatically fed through the gap "t" by compression between the heated cylinder and the presser cylinder and onto conveyor 88 while being thermally treated.

It will be understood, of course, that as the material "m" passes between the heated cylinder and the presser cylinder, it is urged against the surface of the heated cylinder such that its surface will be thermally treated as desired. Various thermal treatments can thus be performed upon the material, including the rendering of an embossing pattern upon the material through the provision of appropriate raised and/or recessed portions on the surface of the presser cylinder or heated cylinder. As the material "m" proceeds over the presser cylinder, variations in its thickness will be compensated for by radial movement of the rings 74 of the presser cylinder and by resilient layer 64 on the drive cylinder. The cooperation of the ring members on the presser cylinder and of the resilient layer on the drive cylinder prevents the thermal degradation of the resilient layer since it is not in the immediate proximity of the heated cylinder during processing of the material. The construction of the presser cylinder thus permits ring member 74 to be formed from material which is capable of resisting the higher temperatures. It will also be appreciated that the provision of cooperable elements 52, 54 on the lever member and beam, respectively provides for a simple adjustment of the clearance "t" between the heated cylinder and the presser cylinder. Further, the pivotable relationship between the lever member and frame and between the beam and lever member affords simple shut-off and reactivation control for the machine whereby no readjustment of the clearance is required.

As stated above, the apparatus of the invention is particularly useful in connection with the thermal processing of natural and artificial leathers and skins. However, the apparatus can also be employed in connection with the production and/or processing of paper, cardboard, plywood, and similar sheeted materials.

Although several embodiments and variations have been suggested herein, others will be obvious to those skilled in this art. Accordingly, the present disclosure should be taken as illustrative only and not as limiting of the scope of this invention.

What is claimed:

1. The apparatus for the continuous thermal treatment of flexible sheet material such as skins, leathers and the like comprising a frame, a heated cylinder rotatably mounted on said frame and a presser cylinder arranged in parallel relation to the heated cylinder and spaced therefrom to permit passage of the sheet material therebetween, means for mounting the presser cylinder and for regulating the spacing between the presser and heated cylinders comprising a lever member pivotably carried by the frame, a beam member extending generally parallel to the presser cylinder and mounted pivotably on said lever member, a drive cylinder rotatably carried by said frame on the side of said presser cylinder remote from said heated cylinder and extending parallel to said presser cylinder, said presser cylinder being freely supported on said drive cylinder and rotatable thereby, means for selectively pivoting said beam member for regulating the spacing between said presser and heated cylinders, and means for selectively pivoting said lever member relative to said frame.

2. Apparatus according to claim 1, including stop means carried by said frame for limiting the pivotal movement of said lever member.

3. Apparatus according to claim 1, wherein said means for selectively pivoting said beam member relative to said lever member comprises first and second cooperable elements carried, respectively, by said beam and lever members.

4. Apparatus according to claim 3, wherein said first element comprises gear means mounted at longitudinally spaced locations of said beam member and said second element comprises linking means mounted on said lever member at locations thereon in correspondence with the location of said gear means on said beam member, and including bar means connected to all of said gear means for synchronously moving same relative to the linking means on said lever member.

5. Apparatus according to claim 1, wherein said presser cylinder comprises a shaft and a plurality of ring elements rotatably positioned on said shaft and individually slidable radially thereon relative to each other, means being provided for guidingly retaining said rings on said shaft in substantially fixed axial relationship thereto.

6. Apparatus according to claim 1 or 2, including fluid motor means pivotably carried by said frame and connected to said lever member for effecting pivotal movement thereof.

7. Apparatus according to claim 2, including fluid motor means pivotably carried by said frame and connected to said lever member for effecting pivotal movement thereof between said stop means, said stop means comprising a pair of spaced stop elements.

8. Apparatus according to claim 7, including control means operably connected to said fluid motor means for selectively actuating same to effect pivotal movement of said lever member in a first direction to the limit defined by one of said stop elements so as to move said presser cylinder away from said heated cylinder and for selectively actuating said fluid motor means to effect pivotal movement of said lever member in the opposite direction to the limit defined by the other of said stop elements so as to return said presser cylinder to the original predetermined spaced position relative to said heated cylinder.

9. Apparatus according to claim 1, including a resilient layer on the outer peripheral surface of said drive cylinder.

* * * * *